United States Patent [19]

Davis

[11] 3,999,529

[45] Dec. 28, 1976

[54] MULTIPLE PLUNGER FUEL INJECTION PUMP

[75] Inventor: Charles W. Davis, Simsbury, Conn.

[73] Assignee: Stanadyne, Inc., Hartford, Conn.

[22] Filed: May 19, 1975

[21] Appl. No.: 578,728

[52] U.S. Cl. ..... 123/139 BD; 123/139 AF; 123/139 AR

[51] Int. Cl.[2] ..... F02M 41/08

[58] Field of Search ..... 123/139 AR, 139 AF, 123/139 BD

[56] References Cited

UNITED STATES PATENTS

| | | | |
|---|---|---|---|
| 2,147,390 | 2/1939 | Vaudet | 123/139 AR |
| 2,624,327 | 1/1953 | Hogeman | 123/139 BD |
| 2,640,419 | 6/1953 | Evans et al. | 123/139 BD |
| 2,794,397 | 6/1957 | Burman | 123/139 BD |
| 3,848,576 | 11/1974 | Hofer | 123/139 AF |

*Primary Examiner*—Wendell E. Burns
*Assistant Examiner*—David D. Reynolds
*Attorney, Agent, or Firm*—Prutzman, Hayes, Kalb & Chilton

[57] ABSTRACT

A multiple plunger fuel injection pump includes a pair of axially positionable interconnected control sleeves encircling each plunger for controlling the quantity and timing of fuel delivered by the plunger. Speed and load response actuators are operative to control the axial positioning of each sleeve of each pair of control sleeves. Adjustment means are provided for separately adjusting, during operation of the injection pump, the axial positioning of each sleeve to balance the timing and quantity of fuel delivered by each plunger with respect to the other plungers.

11 Claims, 4 Drawing Figures

FIG. 3
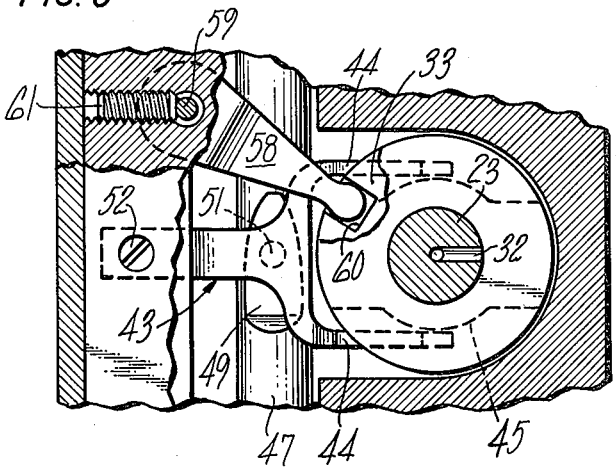
FIG. 2
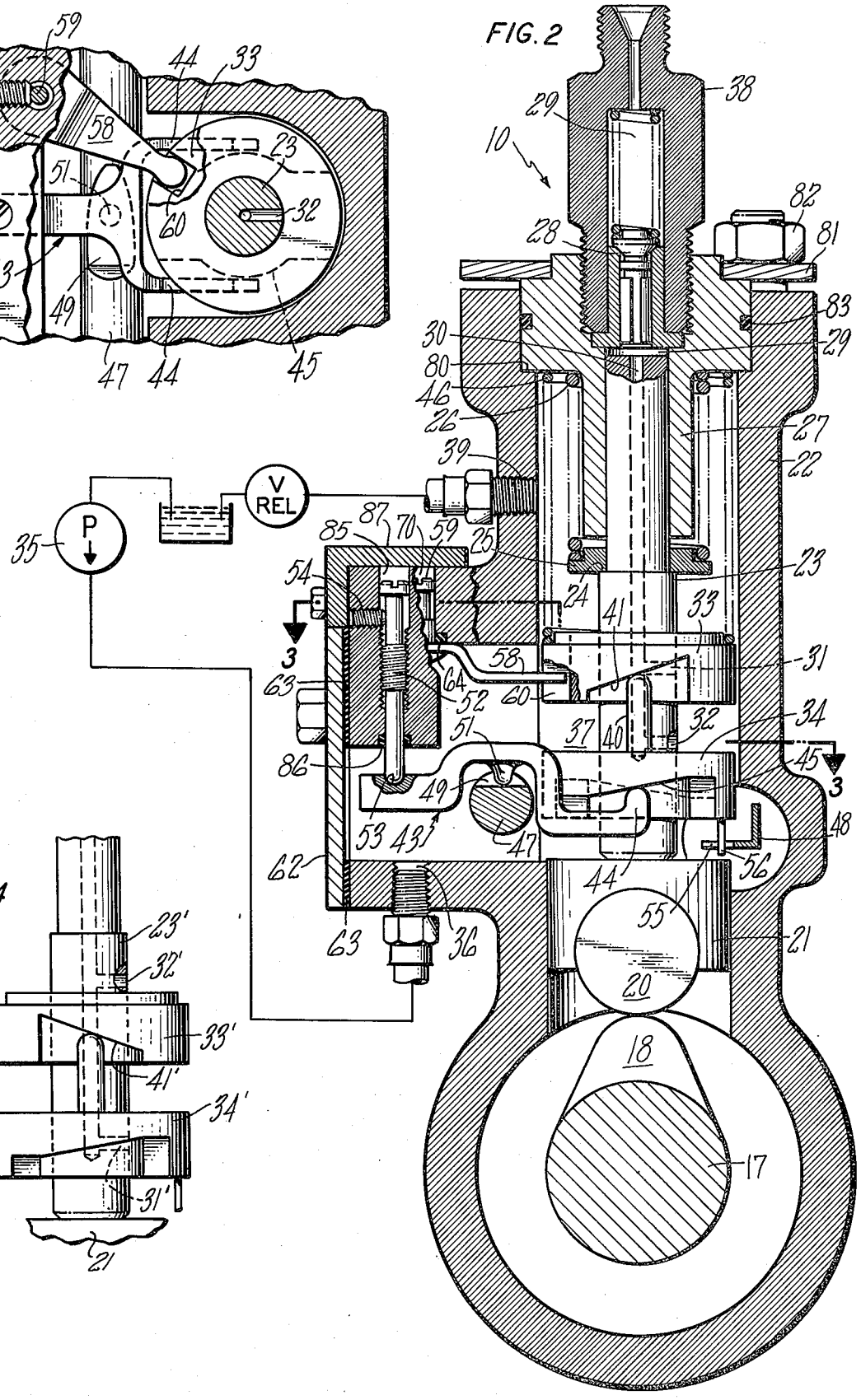
FIG. 4

MULTIPLE PLUNGER FUEL INJECTION PUMP

SUMMARY OF THE INVENTION

This invention relates to a fuel injection pump for an internal combustion engine and more particularly to a multiple plunger fuel injection pump with fuel injection timing and quantity control within the fuel injection pump responsive to engine speed and load conditions.

Multiple plunger fuel injection pumps have utilized fuel injection timing and metering, or quantity, controls which are built into the pump itself. However, these timing and quantity controls have generally required difficult and precise machining in their manufacture, are subject to high forces and wear which may affect the control accuracy, and may permit a delivery imbalance to exist between the several plungers which results in engine "loping" as indicated by an intermediate exhaust beat.

Accordingly, it is a principal object of the present invention to provide a multiple plunger fuel injection pump incoporating a new and improved timing and quantity and control responsive to speed and load conditions of the engine. Included in this object is the provision of a pump according to the invention in which the timing and quantity control of each plunger is individually adjustable thereby to allow balancing of the multiple plungers and in which the adjusting mechanism is simple, accurate and readily accessible during pump operation.

It is a still further object to provide a pump according to the invention having a longitudinally movable control sleeve encircling each plunger and supported in a manner which prevents cocking of the sleeve.

It is another object to provide a pair of interconnected sleeves for controlling the change of timing with speed and/or load according to predetermined programmable schedules established by cam profiles.

It is an even further object to provide a pump according to the invention having multiple in-line sleeve controlled plungers not requiring means to prevent rotation of each plunger about its longitudinal axis.

It is another object to provide a pump according to the invention having reduced complexity and cost of manufacture.

Other objects will be in part obvious and in part pointed out more in detail hereinafter.

A better understanding of the invention will be obtained from the following detailed description and the accompanying drawings of an illustrative application of the invention.

BRIEF DESCRIPTION OF THE DRAWINGS

In the drawings:

FIG. 2 is a sectional view, taken substantially along line 2—2 of FIG. 1;

FIG. 3 is a plan view of a part of the fuel pump, taken along line 3—3 of FIG. 2, showing part of the sleeve positioning mechanism; and FIG. 4 is a modification of the plunger and control sleeve combination.

DESCRIPTION OF THE PREFERRED EMBODIMENT

Figure 1:
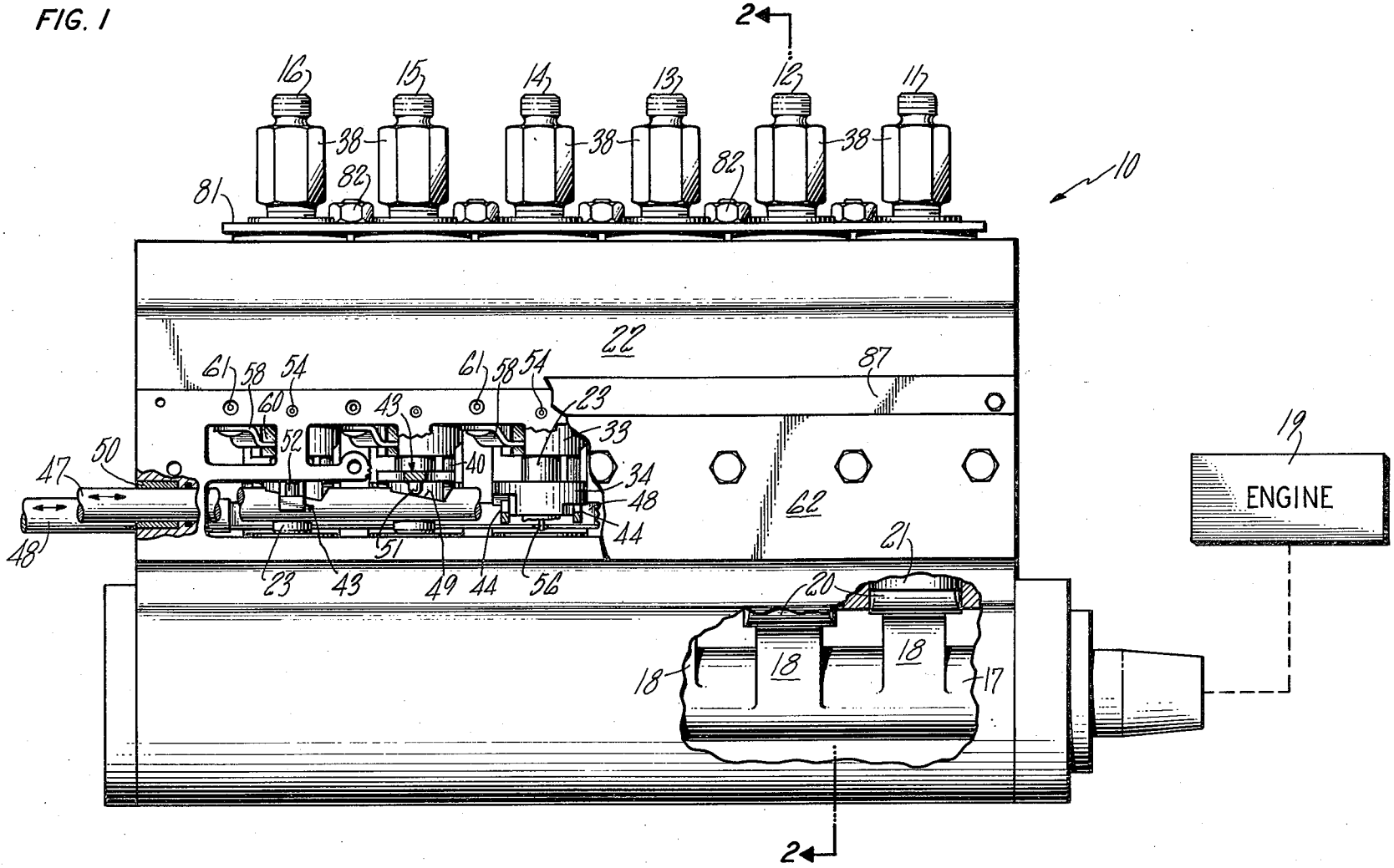
FIG. 1 is a side elevation view, partially in section, of a sleeve controlled, multiple plunger fuel pump incorporating the present invention.

Referring to the drawings, FIG. 1 illustrates a multiple plunger, sleeve controlled, in-line fuel injection pump 10 having a plurality of cam operated in-line pump assemblies 11, 12, 13, 14, 15 and 16. The cam shaft 17 includes a plurality of cams 18, a different cam being associated with each of the assemblies 11–16 for the operation thereof. Cam shaft 17 is engine driven and directly connected to the Diesel engine 19. A conventional cam follower roller 20 is supported by cam follower shoe 21 for rolling contact with a cam 18. Cam follower shoe 21 rides up and down within a guideway defined by pump housing 22. As the structure of each assembly 11–16 is essentially the same, only one will be described hereinafter in detail.

As shown in FIG. 2, the cam follower shoe 21 engages a rod-like plunger 23 in each pump assembly which is radially supported along its upper extent by a cylinder 27 which is supported in the pump housing 52 by an upwardly and inwardly facing support seat 80 formed by the housing near its upper end. The cylinder 27 is maintained in position on seat 80 by a clamping plate 81 and clamping nuts 82 acting downwardly thereon. An O-ring 83 provides a seal between cylinder 27 and housing 22. Each cylinder 27 provides a bore within which plunger 23 slidingly reciprocates to define a pump chamber 29 in which charges of fuel are pressurized. A shoulder 24 shown as being about midway along the length of plunger 23 provides an upwardly facing support surface for annular support plate 25 which in turn provides the lower seat for plunger compression spring 26. The cylinder 27 provides the other seat for the compression spring 26 which acts to bias plunger 23 downwardly into continuous contact with cam follower shoe 21. A delivery valve 28 is positioned and retained in cylinder 27 by a fitting 38 in threaded engagement with the cylinder and adapted for connection to a combustion chamber of an internal combustion engine.

Fuel from a supply pump 35 passes through port 36 into a supply chamber 37 within the housing 22. The cam shaft compartment may also be filled with fuel through passages (not shown) providing communication with the supply chamber 37. Excess fuel may exit from supply chamber 37 through outlet opening 39 and returns to the fuel tank through a pressure relief valve.

Plunger 23 has an axial drilled passage 30 communicating with a pair of axially spaced radial ports 31 and 32 in the lower portion thereof which is located in supply chamber 37. In this embodiment, port 31 is a start of pumping port and port 32 is an end of pumping, or spill, port. Passage 30 extends upwardly from ports 31 and 32 and into communcation with pump chamber 29. A pair of control sleeves 33 and 34 encircle the plunger 23 in close axial sliding relationship therewith intermediate cam follower shoe 21 and plate 25 for selectively opening and closing ports 31 and 32 as will be hereinafter described. The radially inner surface of each of the control sleeves 33 and 34 is continuous around the full periphery of both sleeves to provide a port closure with the plunger 23 regardless of its relative rotational orientation, thereby permitting a simplified design of the plunger in which it is free to rotate relative to the sleeves.

Sleeves 33 and 34 and ports 31 and 32 are located in supply chamber 37 for selectively controlling the introduction and discharge of fuel to pump chamber 29 via passage 30 from supply chamber 37.

The sleeves 33 and 34 are interconnected by a rigid spacing or cam following finger 40 which is press fitted into a blind bore (not shown) in the upper portion of sleeve 34 on one side of plunger 23 and extends axially into contact with a downwardly facing cam surface 41 on sleeve 33 such that relative rotation between sleeves 33 and 34 about plunger 23 results in either increasing or decreasing the axial spacing between the sleeves, depending on the direction of relative rotation. The cam surface 41 has a width which extends from the outer periphery of the sleeve 33 radially inwardly to near, but does not breach the continuity of, the inner periphery of the sleeve. The finger 40 is positioned to contact the cam surface 41 as near the inner periphery of the sleeve 33 as possible in order to minimize any cocking or binding moment of the sleeve relative to the plunger 23.

A bifurcated actuating arm 43, to be described hereinafter in greater detail, controls the vertical positioning of sleeve 34 through vertical contact of its branch fingers 44 with a pair of downwardly facing inclined cam surfaces 45 on the sleeve. The ends of fingers 44 extend upward at an angle to the general extent of arm 43 and are rounded for line or point contact with the cam surfaces 45. Accordingly, the vertical positioning of the sleeve 33 is also controlled by the actuating arm 43 acting through sleeve 34 and the spacing finger 40.

The cam surfaces 41 and 45 extend about the sleeves 33 and 34 respectively over an angular extent which permits about 90° of sleeve rotation and cam surface 45, like surface 41, extend radially inwardly from the outer periphery of sleeve 34 a sufficient distance to accommodate their respective followers, but not so far that they breach the continuity of the inner periphery of the sleeve and create undesired fluid communication between the supply chamber 37 and the port 32 in the freely rotatable plunger 23.

Referring briefly to the fuel injection operation of a single one of the pump assemblies 11–16, fuel under pressure from supply chamber 37 is admitted to passage 30 in the plunger through port 31 when the port is positioned below the lower extent of sleeve 33. As the plunger 23 is moved upward relative to housing 22 and sleeves 33, 34 by cam 18, the port 31 is closed by sleeve 33. Continued upward movement of plunger 23 is effective to reduce the volume of fuel injection pump chamber 29 adjacent its upper end, thereby pressurizing the fuel in the pumping chamber to open the delivery valve 28 to discharge fuel into the outlet fitting 38 through a high pressure line in a fuel injection nozzle to a combustion chamber of the associated engine. It will be understood that the axial positioning and vertical extent of the sleeve 34 are such that the spill port 32 remains covered by the sleeve 34 during the admission and compression of fuel in chamber 29. This compression and delivery of the fuel continues during each stroke of plunger 23 until such time as the spill port 32 is opened by clearing the upper surface of sleeve 34, whereupon communication is re-established between the pumping chamber 29 and the fuel supply chamber 37 and the injection pressure is spilled, the delivery valve 28 closes, and injection is terminated in a conventional manner. This cycle is repeated with every revolution of cam shaft 17.

The quantity or metering of fuel delivered in each compression stroke of plunger 23 is determined by the axial spacing between sleeves 33, 34. In the embodiment illustrated in FIG. 1, if sleeves 33, 34 are positioned axially closer to one another, the start port 31 will be closed earlier and/or the spill port 32 will be opened later, thereby increasing the quantity of fuel delivered. Conversely, if the axial spacing between sleeves 33, 34 is increased, start port 31 will be closed relatively later and/or spill port 32 opened relatively sooner thereby reducing the quantity of fuel delivered. Further, it will be evident that the time in each cycle at which fuel injection begins may be advanced, retarded or held constant by controlling the time (i.e., position) at which port 31 becomes closed by sleeve 33. Likewise, the end of each injection or pumping period may be varied or held constant by controlling the time (i.e., position) at which spill port 32 becomes exposed above sleeve 34.

Generally speaking, the quantity of fuel desired to be injected by plunger 23 during each cycle is dependent upon the load on engine 19 and the desired timing of the fuel injection is dependent upon the speed and load of the engine. The sleeves 33, 34 are positioned axially in response to longitudinal displacement of control rods 47 and/or 48. Briefly, movement of control rod 47 in response to engine speed is operative to axially displace both sleeves 33 and 34 as a unit, correspondingly advancing or retarding the times at which fuel injection begins and ends. Control rod 48 is moved in response to engine load or torque and is operative, through rotation of control sleeve 34, to vary the axial spacing between sleeves 33 and 34 for controlling the quantity of fuel injected and additionally for axially displacing both of the control sleeves for controlling the timing of fuel delivery.

Control rod 47 extends adjacent the line of plungers 23 and is longitudinally reciprocably positioned in response to the speed condition of engine 19 in a well known manner, as through the use of a conventional governor, not shown, connected to an end of the rod which extends beyond the end of housing 22. A plurality of cam surfaces 49 are located on the upper surface of control rod 47 at longitudinally spaced intervals corresponding with the intervals of each plunger 23 and are shaped to vertically displace a cam follower in response to longitudinal displacement. Control rod 47 is supported, as by sleeve 50 in housing 22, for non-rotatable, longitudinal reciprocation to thereby move the cam surfaces 49.

The bifurcated actuating arm 43 for controllably axially positioning the plunger 23 comprises a third class lever havng a general Y-shape when viewed from above, as in FIG. 3. Actuating arm 43 extends transversely of control rod 47 with its branch fingers 44 extending under and upwardly into contact with the cam surfaces 45 on sleeve 34. A rigid, hemispherically headed cam follower 51 extends downwardly from arm 43 near its mid point into vertical contact with cam surface 49 on control rod 47. The fulcrum of the actuating arm 43 is located near its end remote from sleeve 34 and comprises an adjustable pivot, such as the hemispherical end of an adjusting screw 52 which extends downwardly a short distance into a hemispherical pivot seat 53 in the upper surface of the actuating arm.

The cam surfaces 41 on sleeve 33 are maintained in axial contact with the spacing finger 40 by a compression spring 46 seated at its upper end against an axially facing surface of cylinder 27 and acting downwardly on the upper surface of sleeve 33. Sleeve spring 46 also acts downwardly, through sleeve 33 and the finger 40, on sleeve 34, in turn acting downwardly on fingers 44 of cam actuating arm 43 to maintain cam follower 51 in contact with the cam surface 49, and pivot seat 53 in vertical contact with adjusting screw 52. Adjusting screw 52 is in threaded engagement with a tapped section of bore 85 which extends parallel to plunger 23 in a vertical rib of housing 22. Screw 52 is axially positionable, as with a screw driver, and a particular setting is maintained by a set screw 54 extending through a threaded opening in housing 22 into contact with an unthreaded section of screw 52. An O-ring seal 86, seated in housing 22, closely encircles an unthreaded section of adjusting screw 52 to prevent fuel leakage from the housing. Reciprocation of control rod 47, and accordingly cam surfaces 49 thereon, is effective to pivot actuating arm 43 in a vertical plane about the fulcrum established by adjusting screw 52 and thereby axially move control sleeve 34 and accordingly sleeve 33. It will be appreciated that the actuating arm 43 comprises part of the sleeve control mechanism and is not subjected to the relatively large axial forces of the plunger 23 which might adversely affect its performance.

The point contact of cam follower 51 with the planar cam surface 49 on control rod 47, coupled with the ability of pivot seat 53 to universally rotate about the hemisperhical head of adjusting screw 53, enables both of the branch fingers 44 to simultaneously and continuously axially contact cam surface 45 of sleeve 34. The contact ends of fingers 44 extend in a single plane containing the center line or axis of sleeves 33 and 34 for balanced contact with sleeve 34 on opposite sides of the plunger 23. By supporting sleeve 34 in this manner, the tendency for the sleeve to cock or cant itself such that it binds with plunger 23 is essentially eliminated.

Control sleeve 33 is normally retained against rotation by an adjustable lever arm 58 selectively pivotally mounted to the lower end of a slotted-head pivot pin 59 and extending radially therefrom into rotation detenting engagement with control sleeve 33. The upper end of pivot pin 59 is rotably housed in a circular bore 70 extending through housing 22. The detenting end of lever arm 58 comprises a rounded head which is received in a narrow, radially recessed, milled groove 60 extending the full axial length of the control sleeve 33 at its outer periphery to allow relative axial motion of the control sleeve. Slot 60 angularly closely embraces the detenting end of lever arm 58 such that angular positioning of the lever arm serves to angularly position the control sleeve 33. Pivot pin 59 is rotated, as with a screw driver, to achieve a desired angular positioning of lever arm 58, and accordingly, sleeve 33. A set screw 61 extends through a threaded opening in housing 22 into engagement with a radially recessed portion of pin 59 to lock it in position. An O-ring seal 64, seated in housing 22, closely encircles pivot pin 59 to prevent fuel leakage from the housing.

Both adjusting screw 52 and its set screw 54 and pivot pin 59 and its set screw 61 are positioned relatively close to one another to one side of the particular plunger 23 with which they are associated to permit easy access for adjustment. A lower removable cover plate 62 adjacent the pivot end of arm 43 is effective, in combination with seal 63 and housing 22, to close the supply chamber 37 against fuel leakage. A removable upper cover plate 87 serves to cover the exposed ends of adjusting screw 52, pivot pin 59, and their respective set screws 54 and 61, to prevent unauthorized interference with their adjustment and, when removed, exposes the screws and pin for balancing adjustment of each of the assemblies 11–16 during operation of the pump 10.

Elongated control rod 48, generally L-shaped in cross section, extends adjacent the several plungers 23 and a series of notches 55 in the base thereof at intervals therealong corresponding with the intervals of each plunger 23 restrictively engage a drive pin or dog 56 affixed to and depending from control sleeve 34 near its outer periphery. The control rod 48 is supported by conventional sleeve or bearing means, not visible, for longitudinal reciprocable movement, determined by engine load or torque conditions, to rotate sleeve 34 through its engagement with dog 56. A conventional governor system will suffice to longitudinally position the control rod 48.

Rotation of control sleeve 34 relative to control sleeve 33 by control rod 48 is effective to increase or decrease the axial spacing between the control sleeves as a result of the contour of cam surface 41. In the pump 10 illustrated in FIG. 1, control rod 48 rotates control sleeve 34 in the counterclockwise direction, as viewed from above, in response to an increased load condition of the engine, causing sleeves 33 and 34 to be moved axially relatively toward one another, thereby increasing the quantity of fuel delivered. Conversely, rotation of sleeve 34 in the opposite direction during a condition of decreased load is effective to increase the axial spacing between the sleeves and thereby reduce the quantity of fuel delivered. Thus, the profile or contour of cam surface 41 may be of any shape to provide the desired quantity of fuel delivery for any particular engine and load, and the fuel quantity versus load relationship need not be linear.

Inasmch as the cam surfaces 45 are in following contact with the fingers 44 of actuating arm 43, rotation of sleeve 34 by control rod 48 will cause axial movement of that sleeve if the cam surfaces 45 are other than horizontal or perpendicular to the sleeve axis. Thus, the relative angles of the slopes of the cams 41 and 45 control the timing of the beginning and ending of injection as a function of the rotation of sleeve 34 by the control rod 48. If the angles of both cams 41 and 45 were the same, it is evident that the axial positioning of sleeve 33 would be constant throughout the rotation and resulting axial displacement of sleeve 34, thereby establishing a constant beginning of fuel injection. If the cam surfaces 45 were horizontal, the axial positioning of sleeve 34 would remain constant during its rotation, with only sleeve 33 being axially displaced, resulting in a constant spill time or end of injection. As illustrated in FIG. 2, the slope of the cam surfaces 45 is intermediate the two immediately aforementioned examples, resulting in a change in the timing of both the beginning and the ending of fuel injection when the sleeve 34 is rotated to control the quantity of fuel delivered. It will be appreciate that the profile of cam surface 45 may be contoured to provide the desired timing versus load relationship.

By moving the sleeves 33 and 34 axially in unison, the actuating arm 43 serves to advance or retard the beginning and ending of fuel injection in unison, as determined by the speed requirements of the engine. Upward rotation of the arm 43 and its fingers 44 (counterclockwise as viewed in FIG. 2) serves to retard the timing with downward rotation of the arm advancing the timing. The contour of all of the cam surfaces 49 on the control rod 47 are the same and selected to retard or advance the timing as required by the engine speed condition, generally in a non-linear relationship. The profile of cam surfaces 49 may be contoured to provide the desired timing versus speed relationship at all engine speeds. Thus, it will be appreciated that the relative angles and profiles or contours of cam surfaces 41 and 45, as well as those of surface 49, may be designed to obtain the desired timing and metering of fuel injection as determined by the load requirements and the speed of the engine.

Because of the accumulation of vertical tolerances which may differ from one plunger to the next and result in engine "loping", it is important that the timing and fuel delivery for each pump assembly 11–16 be individually adjustable in order to balance each relative to the other. According to the invention, this balancing or calibration is accomplished by the selective adjustment of one or more of the adjusting screws 52 associated with assemblies 11–16 and/or adjustment of one or more of the pivot pins 59. Adjusting screw 52, through actuating arm 43, permits timing calibration of each plunger 23; and pivot pin 59, through lever arm 58, permits balancing the quantity of fuel delivered by each plunger 23. In both instances, the adjustments may be made during operation of the pump 10, thereby permitting a rapid and accurate balancing of the several pump assemblies 11–16 without need to shutdown and change parts.

An alternative arrangement of the control sleeves is depicted in FIG. 4 wherein the positions of the inlet port 31' and spill port 32' are reversed relative to that illustrated in the FIG. 2 embodiment. In this instance, lower control sleeve 34' is operative to control the start of pumping or fuel injection, and the upper sleeve 33' is operative to control the end of pumping or spill time. It will be noted that while control sleeve 34' is identical in all respects to that illustrated in FIG. 2, the cam surfaces 41' on control sleeve 33' are at an angle which is reversed relative to that illustrated in FIG. 2, as required by the reversal of the positioning of ports 31' and 32'.

The counterclockwise rotation of sleeve 34' by control rod 48, as viewed from above in FIG. 4, in response to an increase in the engine load condition results in an increased axial spacing between sleeves 34' and 33'. However, because the period of fuel injection begins when inlet port 31' moves upward past the lower edge of control sleeve 34' and terminates when spill port 32' moves above the upper edge of control sleeve 33', the increased axial spacing between the control sleeves is operative to extend the period, and thus the quantity, of fuel injection during each cycle of plunger 23'. Additionally, it will be appreciated that spacing finger 40 might be affixed to the upper sleeve 33 and extend downwardly into following contact with a cam face on the upper surface of control sleeve 34.

As will be apparent to persons skilled in the art, various modifications, adaptations and variations of the foregoing specific disclosure can be made without departing from the teachings of the present invention.

I claim:

1. In a multiple plunger fuel injection pump for an internal combustion engine, a pump having a supply chamber and a plurality of cylinders with a plunger freely rotatable in each of said cylinders to define a plurality of pumping chambers, fuel supply means communicating with said supply chamber, each said plunger having inlet and spill ports communicating with said supply chamber, multiple control sleeve means, each said control sleeve means respectively mounted for longitudinal movement about one of the plungers and cooperating with said plunger ports for controlling the injection of fuel delivered by the plunger, actuating means for actuating said sleeve means longitudinally to a position determined by the speed and load requirements of the engine to thereby control the delivery of fuel to the engine, and multiple adjustment means, each said adjustment means selectively operable individually with a respective different one of said control sleeve means for longitudinally moving said control sleeve means independently of the other control sleeve means to balance said one of said control sleeve means relative to said other control sleeve means, said actuating means comprising multiple lever means and a member adapted to be positioned by the speed of the engine, each said lever means operatively connecting a respective said control sleeve means and said speed positioned member, said lever means being pivotally rotatable in response to positioning of said speed positioned member for longitudinally moving said control sleeve means thereby to control the timing of fuel delivered by said plunger, and each said adjustment means including means for selectively adjusting the position of said lever means relative to said speed positioned member and said sleeve means for longitudinally moving said sleeve means, said lever means being a third class lever and said adjustment means comprising a fulcrum for said lever which is adjustable longitudinally relative to said sleeve means.

2. The fuel injection pump of claim 1, wherein said lever means comprise a bifurcated arm, the two branches of said arm extending on opposite sides of said plunger and longitudinally contacting said sleeve means for longitudinally moving said sleeve means.

3. In a multiple plunger fuel injection pump for an internal combustion engine, a pump having a supply chamber and a plurality of cylinders with a plunger freely rotatable in each of said cylinders to define a plurality of pumping chambers, fuel supply means communicating with said supply chamber, each said plunger having longitudinally spaced inlet and spill ports communicating with said supply chamber, multiple control sleeve means, each said control sleeve means respectively comprising a pair of sleeves mounted for longitudinal movement about one of the plungers and cooperating with said plunger ports for controlling the injection of fuel delivered by the plunger, actuating means for actuating said sleeve means longitudinally to a position determined by the speed and load requirements of the engine to thereby control the delivery of fuel to the engine, multiple adjustment means, each said adjustment means selectively operable individually with a respective different one of said control sleeve means for longitudinally moving said control sleeve means independently of the other control sleeve means to balance said one of said control sleeve means relative to said other control sleeve means, a cam finger affixed to and extending longitudinally from one said sleeve for longitudinal contact with a cam surface facing said one sleeve at an inclined angle thereto on the other said sleeve thereby to vary the longitudinal spacing between said pair of sleeves in response to relative rotation therebetween for controlling the quantity of fuel delivered by said plunger, said actuation means comprising a member adapted to be positioned as determined by the load requirements of the engine, means for maintaining said cam finger in longitudinal contact with said cam surface, and means connecting said load positioned member to a first said sleeve of said pair for rotation of sad first sleeve as determined by the load requirements of the engine, said adjustment means comprising means operably connecting the second said sleeve of said pair with said housing for selectively variably fixing the angular relationship therebetween to permit said relative rotation of said first and second sleeves.

4. The fuel injection pump of claim 3, wherein said multiple adjustment means are accessible for individual adjustment during operating of the pump.

5. The fuel injection pump of claim 4, wherein said actuating means additionally comprise a member adapted to be positioned by the speed of the engine and multiple lever means, each said lever means operatively connecting said speed positioned member with one sleeve of each respective said pair of sleeves for moving said sleeve pair longitudinally as a unit, and said adjusting means include means for adjusting the position of said lever means relative to said speed positioned member and said sleeve pair for longitudinally moving said sleeve pair.

6. The fuel injection pump of claim 5, wherein each said lever means comprise a third class lever, said third class lever comprising a bifurcated arm, the two branches of said bifurcated arm extending on opposite sides of said plunger and longitudinally contacting a said sleeve of said pair for said longitudinal movement of said pair of sleeves, and said lever positioning adjustment means comprise a fulcrum for said third class lever adjustable longitudinally relative of said sleeve pair.

7. The fuel injection pump of claim 5, wherein said first sleeve includes a cam surface, said lever means are in longitudinal contact with said first sleeve cam surface for longitudinally moving said sleeve pair as a unit as determined by the engine speed required, and said first sleeve cam is inclined for longitudinally moving said first sleeve relative to said lever means in response to said rotation of said first sleeve by said load responsive actuating member.

8. In a multiple plunger fuel injection pump for an internal combustion engine, a pump having a supply chamber and a plurality of aligned cylinders with a plunger freely rotatable in each of said cylinders to define a plurality of pumping chambers, fuel supply means communicating with said supply chamber, each said plunger having axially spaced inlet and spill ports communicating with said supply chamber, a pair of control sleeves axially sequentially mounted for selective axial and angular movement about each of said plungers, a sleeve of said pair having a first cam surface, a sleeve of said pair having a pair of second cam surfaces on diametrically opposite sides thereof, said first and second cam surfaces facing generally axially at different relative angles and a sleeve of said pair having a rigid cam finger extending axially therefrom for contact with said first cam surface on the other sleeve of said pair; a first reciprocable member adapted to be moved as determined by speed of the engine and having a respective cam surface thereon for each said cylinder; multiple, bifurcated, third class lever means, each said bifurcated lever means mounted for pivotal motion in an axially extending plane in following contact with a respective said cam surface of said first reciprocable member and having the branch fingers thereof positioned for axially directed contact with said pair of second cam surfaces of a said sleeve of each said pair to move said sleeve pair axially as a unit for variably controlling the timing of fuel injected by the pump according to engine speed; a second reciprocable member adapted to be moved as determined by the load requirements of the engine and connected to a first said sleeve of each said pair for rotation thereof relative to the second said sleeve thereby to vary the axial spacing between said two sleeves for variably controlling the quantity of fuel injected by the pump according to engine load, said first sleeve including said pair of second cam surfaces thereof for said axial contact with said branch fingers of said bifurcated lever means thereby to move said sleeve pair axially as a unit for variably controlling the timing of fuel injected by the pump according to engine load; means for maintaining said rigid cam finger and said branched fingers in respective axial contact with said first cam surfaces and said pair of second cam surfaces; multiple adjustable lever arms, each said lever arm selectively pivotally rotatable about a respective pivot extending parallel a respective said plunger and operatively connected to a respective second sleeve of each said sleeve pair for selectively fixing the angular positioning of said second said sleeve during operation of said pump to balance the fuel delivery quantity of said sleeve pair relative to remaining sleeve pairs; and multiple adjustable fulcrum means, each said fulcrum means operably associated with a respective said bifurcated lever means and selectively adjustable axially of said sleeves during operation of said pump for selectively pivoting said lever means and moving the corresponding sleeve pair axially thereby to balance the fuel injection timing of said sleeve pair relative to the other sleeve pairs.

9. In a fuel injection pump for an internal combustion engine, a pump having a supply chamber and a cylinder and a reciprocable plunger in said cylinder, fuel supply means communicating with said supply chamber, said plunger having longitudinally spaced inlet and spill ports communicating with said supply chamber, means reciprocating said plunger for pressurizing charges of fuel in said cylinder, a pair of control sleeves mounted about said plunger and cooperating with said plunger ports for controlling the delivery of pressurized fuel from said cylinder, means interconnecting said pair of control sleeves comprising a first cam surface on one sleeve of said pair of sleeves generally facing the other sleeve, a first cam follower member connected to the other said sleeve and extending longitudinally for contact with said cam surface on the one said sleeve, means for maintaining said cam follower member and said cam surface in contact, and means for rotating one of said sleeves relative to the other to vary the longitudinal spacing therebetween thereby to vary the quantity of fuel delivered.

10. The fuel injection pump of claim 9, including means for moving said pair of sleeves longitudinally in unison thereby to vary the timing of fuel delivery.

11. The fuel injection pump of claim 9, wherein the angular position of one of each sleeves is fixed and the other of said sleeves is rotatable, a second cam surface on one of said sleeves facing generally longitudinally, and a second cam follower member maintained in longitudinal contact with said second cam surface and relatively rotatable therewith to vary the timing of fuel delivery.

* * * * *